US005492169A

United States Patent [19]

Valadon

[11] Patent Number: 5,492,169

[45] Date of Patent: Feb. 20, 1996

[54] TUBE LANE PIVOTING DEVICE FOR NUCLEAR STEAM GENERATOR

[75] Inventor: Christian Valadon, Paris, France

[73] Assignee: Framatome, Paris la Defense, France

[21] Appl. No.: 320,679

[22] Filed: Oct. 11, 1994

[30] Foreign Application Priority Data

Oct. 8, 1993 [FR] France ..... 93 12031

[51] Int. Cl.[6] ..... F28F 27/00

[52] U.S. Cl. ..... 165/96; 165/160; 376/402

[58] Field of Search ..... 376/203, 402, 376/463; 165/159, 160, 161, 96, 72; 122/382, 383, 406.3

[56] References Cited

U.S. PATENT DOCUMENTS 4,037,569 7/1977 Bennett et al. ..... 122/383
4,079,701 3/1978 Hickman et al. ..... 122/382
4,664,178 5/1987 Echols et al. ..... 165/160
5,104,611 4/1992 Woods et al. ..... 165/160
5,335,631 8/1994 Daffos et al. ..... 122/383

FOREIGN PATENT DOCUMENTS 2352269 12/1977 France .

OTHER PUBLICATIONS

Search Report FR 93 12031.

*Primary Examiner*—Daniel D. Wasil
*Attorney, Agent, or Firm*—Pollock, Vande Sande & Priddy

[57] ABSTRACT

A steam generator for a nuclear power station in which the flow of secondary fluid is deflected and distributed by a block articulated on a fixed horizontal pivoting spindle, such as to retain maintenance access to the tube place by tooling introduced through orifices in the outer casing, and to eliminate dead zones difficult to access for cleaning and servicing the tubes.

11 Claims, 5 Drawing Sheets

TUBE LANE PIVOTING DEVICE FOR NUCLEAR STEAM GENERATOR

FIELD OF THE INVENTION

The present invention relates to a steam generator in particular for a nuclear power station, including an outer casing of vertical axis, a horizontal tube plate, fixed in a leaktight manner inside and at the lower end of the casing, a bundle of inverted-U tubes, comprising vertical branches, respectively hot and cold joined by a bond part at their upper ends and traversed by a primary fluid which yields its heat, inside the exchanger, to a secondary fluid flowing through the outer casing. The branches of the tubes have their ends connected to the tube plate and emerging thereunder, respectively in an inlet manifold for the hot primary fluid and an outlet manifold for the cooled fluid. An inner casing covers the tube bundle, the lower edge of which is separated from the tube plate and delimits with the outer casing an annular space traversed by the secondary fluid introduced into this casing in this space before vaporizing in contact with the tubes traversed by the primary fluid steam extraction means are arranged above the bundle of the tubes in the outer casing, and means for deflecting and distributing the flow of the secondary fluid are provided at the lower part of the inner casing, these deflection means delimiting with the tube plate, on the one hand, and the hot and cold branches of the nearest tubes, on the other hand, an elongate central region extending transversely through the outer casing, this region being occupied by means for blockage or partial occupation of the passage afforded to the secondary fluid in this region.

The secondary fluid, usually water, contains particles of matter, principally in the form of iron oxides or copper compounds, or alternatively traces of other metals, which tend to deposit on the tube plate, in particular in the central region thereof, between the closest branches of the U-shaped tubes where the speed of flow of the secondary fluid from one end of the plate to the other is insufficient to prevent deposition of sludge or other residues which are harmful, because they create concentrations of corrosive agents along the outer walls of these tubes.

The means of blockage or partial occupation arranged in this central region, generally called the "tube lane", by reference to the conventional expression "tube lane blocking device", the term blocking in fact rather indicating obstruction of this region, therefore have the object of reducing to a minimum the flow of the secondary fluid in the corresponding passage between the closest tubes, with a view to increasing the lateral flow through the bundle, while reducing the deposition of sludge in this passage. These means generally consist of parallelepipedal metal blocks, mounted permanently in the central region between the tubes and resting on the plate along the diameter thereof in this region.

It should be noted that, depending on the type of steam generator in question, of the type called "axial economizer steam generator" or "boiler steam generator", the tube lane constituting the aforementioned central region may or may not be separated in the midplane of the generator by a vertical deflector, fixed to the tube plate and extending at the middle of the passage delimited between the branches of the tubes in this region, the blocking means being in a single piece and housed in the latter in the first case, or formed of two symmetrical parts, arranged respectively on either side of the vertical deflector in the other, between this deflector and the branches of the facing tubes.

BACKGROUND OF THE INVENTION

With such blocking means which are immobilized on the tube plate, it is sometimes difficult to carry out the necessary maintenance operations at this plate, in particular in its surface which points towards the inside of the steam generator, for cleaning the tube plate or for checking the tubes and especially their linkage with the plate. Furthermore, in certain solutions in which the tube plate is equipped with a continuous blow down device, including in particular a pipeline parallel to the plate and pierced with holes distributed over its length for continuous sampling of water through this plate, the presence of these means may constitute a problem for obtaining optimal operation.

By way of example, in order to produce such a blow down system, it is possible to employ the arrangements described in Applicant's FR-A-92 07903, filed Jun. 26, 1992, in which these blow down means include at least one passage through the tube plate, through which an opening emerges on the upper face of this plate in the central region, this opening communicating with drainage means situated outside the casing of the generator.

SUMMARY OF THE INVENTION

The object of the present invention is a steam generator of the aforementioned type, in which the tube lane blocking means are arranged so as not to hinder maintenance of the tube plate, allowing in particular access thereto by tooling introduced into the outer casing through suitable orifices, and furthermore eliminating dead zones which are inaccessible or difficult to access during operations of cleaning the tube plate or servicing the tubes.

For this purpose, the generator in question, including blocking means which are in the form of at least one block, preferably of parallelepipedal general shape, housed in the central region, is characterized in that the block is articulated on a fixed horizontal pivoting spindle mounted inside the outer casing and extending perpendicularly to the midplane of the central region between the hot and cold branches of the tubes of the bundle, so as to allow tilting of this block away from the tube plate, uncovering the said region above this plate.

Advantageously, the pivoting spindle is supported by a clevis integral with the deflection and distribution plate for the flow carried by the inner casing, extending parallel to and above the tube plate.

According to another characteristic, the parallelepipedal block includes at least one open housing capable of receiving one temporary immobilization pin holding the block bearing on the tube plate, preventing it from rising under the effect of the speed of the secondary fluid flowing between the bundle of the tubes, this pin being slidingly mounted with respect to the housing, so as to be able to free the latter and allow it to tilt about the pivoting spindle.

Preferably, the pin is supported by a closure cover closing an access and visit hole made in the outer casing in the vicinity of the tube plate, substantially in the midplane of the central region.

Also preferably, the pin engages in its housing after passing through a sliding closure member carried by the inner casing, covering the bundle of the tubes capable of being aligned with the parallelepipedal block, this pin including a telescopic mounting comprising a support finger integral with the cover penetrating in a blind bore made in the pin, a return spring being mounted between the cover and a bearing shoulder on the pin, so as to exert thereon a continuous force for engagement in the housing of the block.

Also, according to another characteristic, the pin has a conical profile, capable of interacting with a similar profile of the housing of the block.

According to yet another characteristic, the sliding closure member is supported by the inner casing so as to be able to retract in the direction of the upper part thereof, after withdrawal of the pin and release of the block, in order to allow free tilting of the latter, without disturbing the flow of the secondary fluid arriving through the annular space between the outer and inner casings.

Also preferably, the block is guided laterally in its tilting movement by two parallel slides, delimiting the sides of the central region between the tubes on either side of the block. Depending on the case, the slides are integral with the tube plate or with the sliding closure member.

Finally, according to another characteristic, the block is made in a single piece (in the case of a generator of the boiler type), or in two parallel parts (in the case of an economizer type generator), the immobilization pin being single or double and in the latter case straddling a vertical deflector integral with the tube plate.

Finally, preferably but not exclusively, the block is formed by a plurality of juxtaposed elements, arranged in the extension of each other in the longitudinal direction of the central region, these elements each including passage openings for the secondary fluid.

BRIEF DESCRIPTION OF THE DRAWINGS

Other characteristics of a steam generator comprising tube lane blocking means mounted pivotably in the tube lane will emerge from the following description of several embodiments, given by way of example and with reference to the attached drawings, in which.

DETAILED DESCRIPTION

Figure 1:
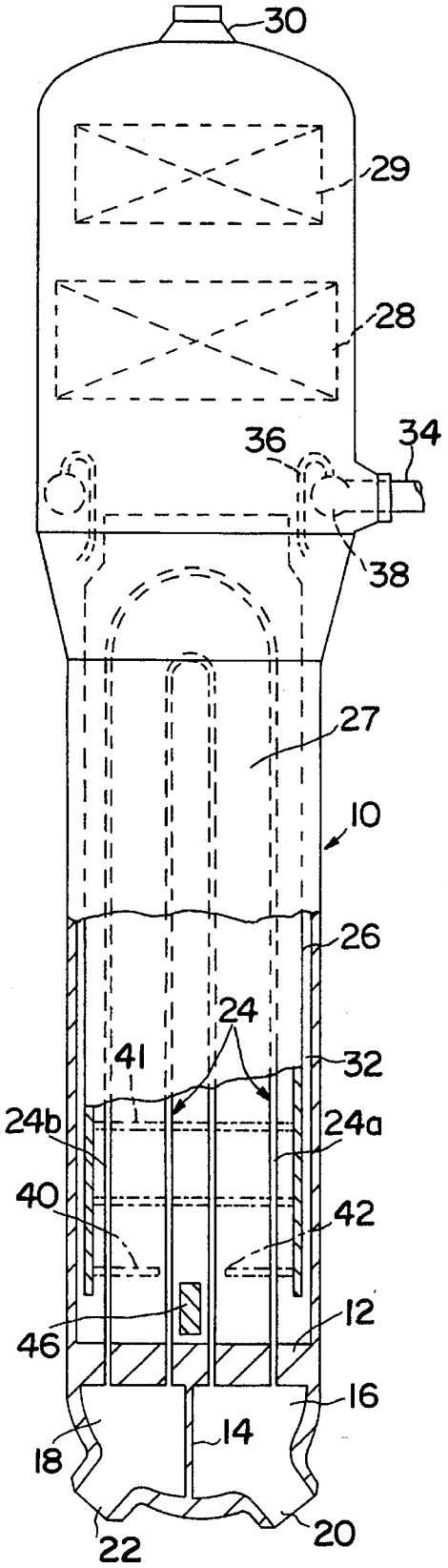
FIG. 1 PRIOR ART
FIGS. 1 and 2 are schematic views in partial vertical section of steam generators of a general type known in the art, FIG. 1 representing a generator of the boiler type and FIG. 2 a similar generator but of the axial economizer type.

FIG. 1 schematically represents a steam generator of the boiler type, illustrating a first possible embodiment of the invention. This steam generator is intended to transfer heat between the primary water circuit and the secondary water/steam circuit of a pressurized water nuclear reactor.

FIG. 1 shows the outer axisymmetric casing 10, of vertical axis, of the steam generator. This casing 10 delimits a closed internal space which is separated into a primary lower region and a secondary upper region by a horizontal tube plate 12 connected in a leaktight manner onto the casing 10.

A vertical partition 14 divides the primary lower region, normally called water box, into an inlet manifold 16 and an outlet manifold 18 of the water flowing in the primary circuit of the reactor. Nozzles 20 and 22, welded or forged or molded on the outer casing 10 of the steam generator respectively connect the manifolds 16 and 18 to this primary circuit.

A bundle 24 of inverted-U tubes is connected in a leaktight manner onto the tube plate 12, in the secondary upper region delimited by the latter, such that the two ends of each of the tubes respectively emerge in the inlet manifold 16 and in the outlet manifold 18. The vertical branches 24*a* of the tubes 24 which emerge in the inlet manifold 16 are called hot branches, and the vertical branches 24*b* of the tubes 24 which emerge in the outlet manifold 18 are called cold branches.

The tube bundle 24 is surrounded and covered by an internal casing 26, arranged coaxially in the outer casing 10. The horizontal upper wall of this inner casing 26 emerges in water/steam separators 28 surmounted by driers 29 which connect the space 27 made inside the casing 26 with a steam outlet nozzle 30 situated at the top of the outer casing 10. The lower edge of the inner casing 26 is placed at a determined distance above the tube plate 12, so as to form a passage between an annular recirculation space 32 delimited between the casings 10 and 26 and the space 27 formed in the inner casing 26.

The steam generator is supplied with secondary water by a toric supply distributor 38 situated immediately above the annular recirculation space 32. A supply nozzle 34 passes in a leaktight manner through the outer casing 10 of the steam generator and emerges in the supply distributor 38. The latter may in particular be connected to the annular recirculation space 32 by tubes 36 in the form of an inverted J.

Regularly spaced horizontal flow distribution plates 41 are mounted inside the inner casing 26. These plates include perforations making it possible to support the tubes 24 of the bundle over their entire height and to produce a radial distribution of the secondary water flow rising in the casing 26 which is as homogeneous as possible.

The lower flow distribution plate in FIG. 1, is situated slightly above the lower edge of the inner casing 26. It differs from the other plates 41 in that it includes a central opening 42 of relatively large cross-section. This lower plate 40 thus makes it possible to prevent the secondary water descending through the annular recirculation space 32 from immediately rising again when it has cleared the lower edge of the inner casing 26, which would result in creation above the central part of the tube plate 12 of a static region.

In a manner which is known in the art, in order as much as possible to prevent a region where the secondary fluid is practically stagnant, being established between the hot and cold branches of the tubes 24 in the central region of the generator, blocks 46 are arranged in this region which are capable of occupying and partly closing it. These blocks 46 are generally fitted and then immobilized with respect to the tube plate 12, and therefore present certain drawbacks for allowing maintenance of the tubes at their connection with the plate.

Figure 2:
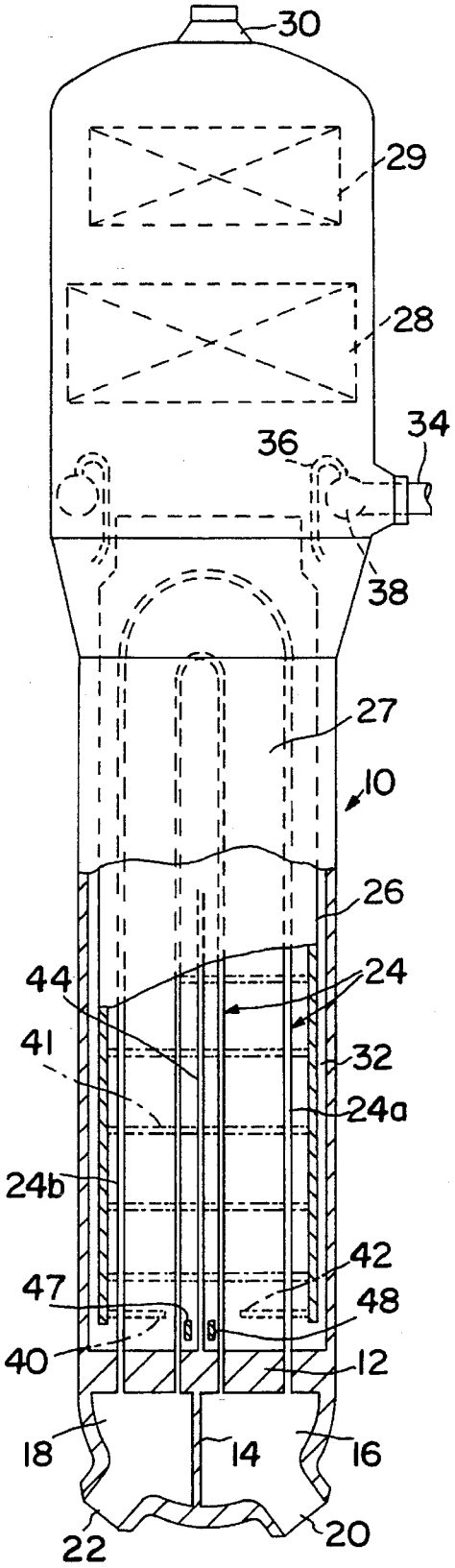
FIG. 2 PRIOR ART

FIG. 2 illustrates a steam generator which is practically identical to that represented in FIG. 1, but this time is of the so-called axial economizer type, the central region or tube lane between the closest branches in the exchanger, being separated by a vertical partition 44 integral with the tube plate 12 and extending vertically therefrom. In this variant, the blocks occupying the tube lane consist of separate elements, respectively 47 and 48, arranged on either side of the vertical partition 44.

Figure 3:
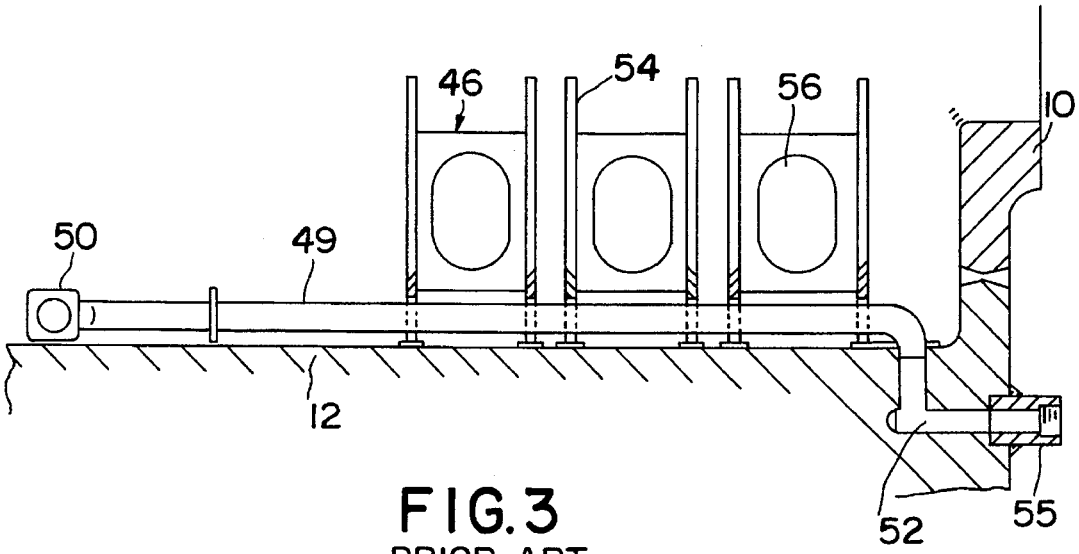
FIG.3 PRIOR ART
FIGS. 3 and 4 are views on a larger scale, respectively in elevation and plan, of a part of a steam generator according to either of FIGS. 1 or 2, representing the structure known per se of blocks or members for obstruction or blockage, housed permanently in the central region or tube lane of such a generator.
Figure 4:
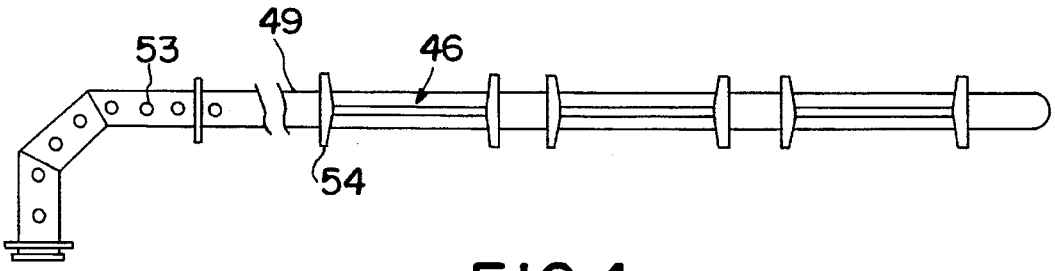
FIG.4 PRIOR ART

FIGS. 3 and 4 illustrate in greater detail the structure of the closure blocks 46 housed in the central region of the bundle of the tubes in the case of a generator of the boiler type according to FIG. 1, similar arrangements being clearly employed with the generator in FIG. 2.

In these figures, the blocks 46 include vertical support uprights 54 and are advantageously provided with orifices 56 intended not to excessively hinder the flow of the secondary fluid. These blocks rest side by side on the tube plate 12, extending transversely in the tube lane and being associated, in the vicinity of this plate, with a longitudinal nozzle 49 for withdrawing sludge or other residues possibly accumulating on the plate, joined at one end substantially in the center of the plate to a manifold 50, provided with withdrawal orifices 53, of the type more especially described in the abovementioned French Patent Application 92 07903, and extending at its opposite end so as to leave the plate laterally under the lower end of the outer casing 10 to be connected by a pipe 52, associated with a hollow adaptor 55, to an installation for removing this sludge or residue.

In this assembly thus envisaged, the blocks 46 partially occupying the tube lane above the tube plate 12 are immobilized with respect to the latter, and this leads to the drawbacks already mentioned.

In order to avoid these drawbacks, according to the invention, provision is therefore made to arrange the blocks for occupying the central region between the tubes of the bundle such that they can easily be moved inside this region in order to uncover the plate and more easily allow maintenance of the lower end of the tubes for flow of the primary fluids which are connected thereto.

For this purpose, a clevis 60 for supporting a transverse spindle 61 is arranged, preferably under the flow deflection and distribution plate 40, which spindle makes it possible to articulate on this plate a block 62 for occupying the tube lane, by means of a lateral extension of this block, as illustrated in the drawing.

The block 62, of generally parallelepipedal shape, extends transversely in the generator, inside the region 64 constituting the tube lane between the closest branches of the tubes 24 and, in the normal position, during use of the steam generator, rests by its lower end on a support baseplate 66 carried by the plate, or is directly in contact with the upper face of the latter. In the part of the deflection plate 40 which is situated above the block 62, an elongate slot **40*a*** is furthermore provided, the transverse dimension of which is slightly greater than that of the block, so as to allow the latter to pass through the plate, as explained hereinbelow.

Figure 5A:
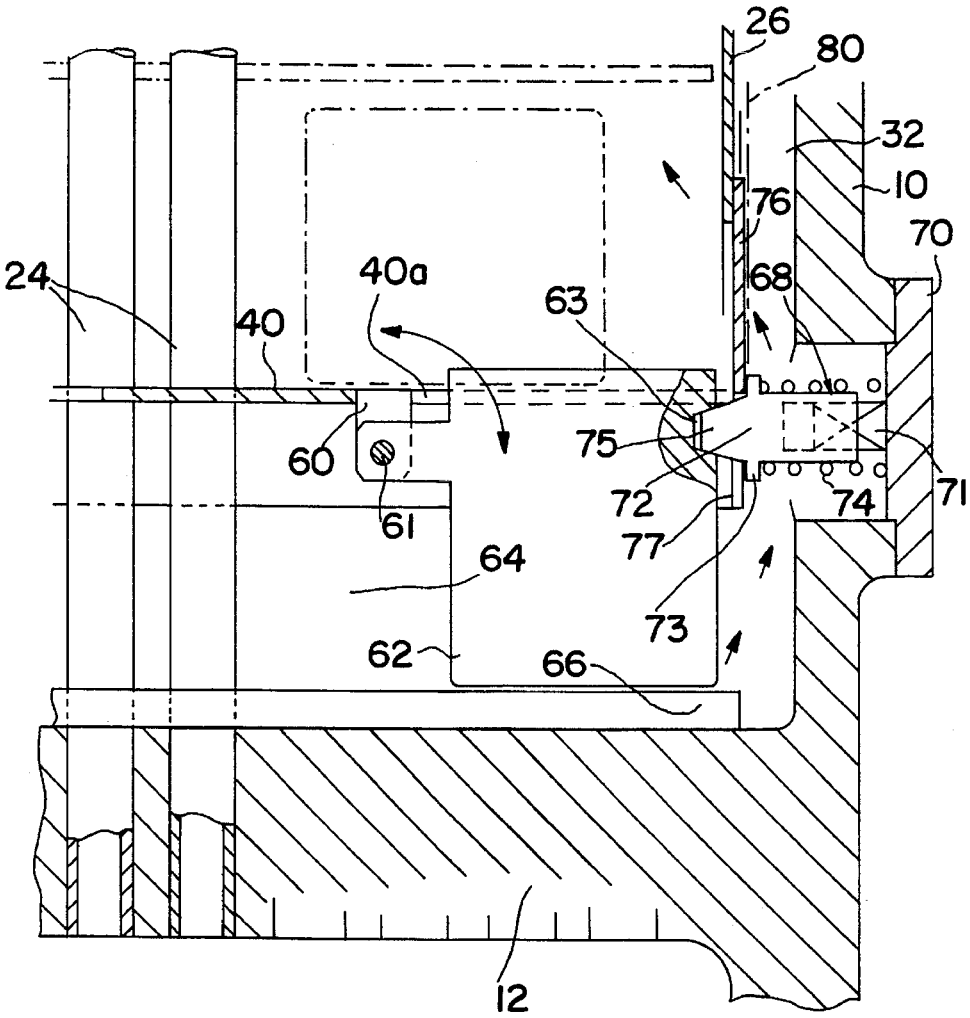
FIGS. 5A and 5B are views, respectively in elevation and in section, on the one hand, and in plan, on the other hand, of a pivoting obstruction block, mounted in the tube lane of a generator according to the invention.
Figure 5B:
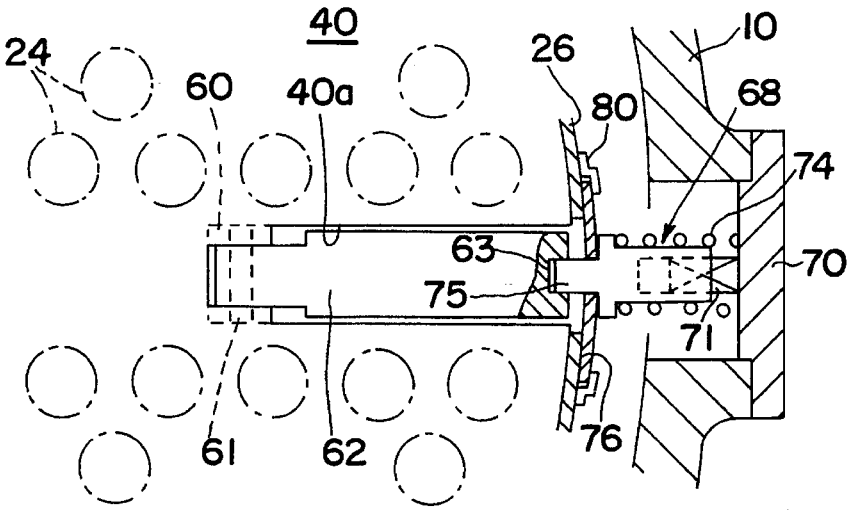

During operation, the block 62 thus pivotably mounted about its spindle 61 must be immobilized in the position represented in FIGS. 5A and 5B, in particular to prevent the block from being lifted inopportunely, under the effect of the flow of the secondary fluid coming from the intermediate space 32 and rising again in between the tubes 24 of the bundle after passing under the lower end of the inner casing 26.

For this purpose, a blocking pin 68 is arranged, facing the block 62, in extension of the midplane of the region 64, a together with a cover 70 for closing a suitable access or visit hole in the sidewall of the outer casing 10, in line with the deflection and distribution plate 40.

The pin 68 is composed of a fixed finger-71 carried by the cover 70 towards the inside of the enclosure of the generator, and an adaptor 72, slidingly mounted on the finger 71, and including a bearing shoulder 73 for a spring 74 applied at its opposite end against the cover 70, so as continuously to exert a force on the adaptor 72 and to allow engagement of the end 75 thereof in a housing 63 of the same shape provided in the facing sidewall of the block 62. Advantageously, the end 75 of the adaptor 72 of the pin 68 and the housing 63 of the block 62 which receives it both have a conical profile.

Thus, as long as the pin 68 has the end 75 of its adaptor 72 engaged in the housing 63 of the block 62, with the cover 70 in place against the access hole in the outer casing 10, block 62 is immobilized in position with its lower face bearing on the baseplate 66 or the plate 12. On the other hand, when the pin 68 is retracted and releases the block 62, especially during servicing or maintenance of the bundle of the tubes 24, the block can be released from the region 64 by pivoting about its spindle 61 to be brought above the deflection plate 40, after passing through the slot **40*a* therein, as schematically represented in broken lines in FIG. 5**A.

It will be observed that the position of the block, like its dimensions, must be exactly calculated so as to allow its free displacement through its pivoting upwards when the region 64 is to be uncovered. In particular, it is essential for the lower end of the inner casing 26 not to impair this pivoting movement, once the blocking pin 68 is retracted.

Figure 6:
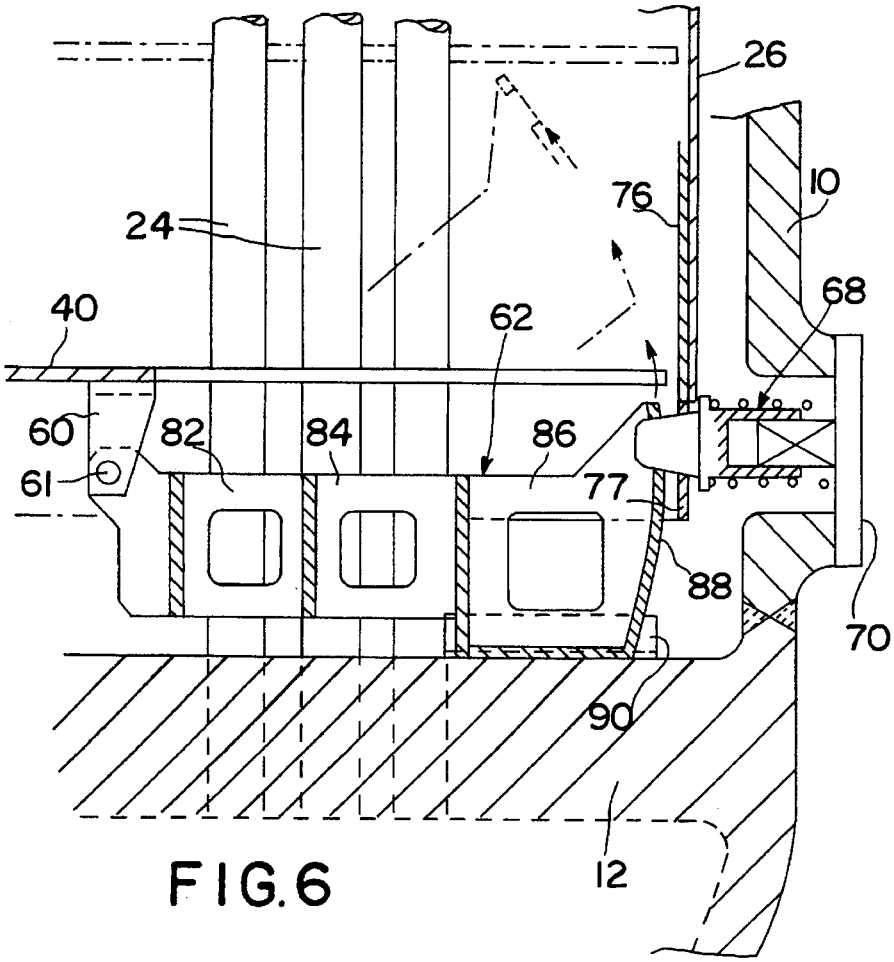
FIG. 6 is a view in elevation and in section of an alternative embodiment of the pivoting block.
Figure 7:
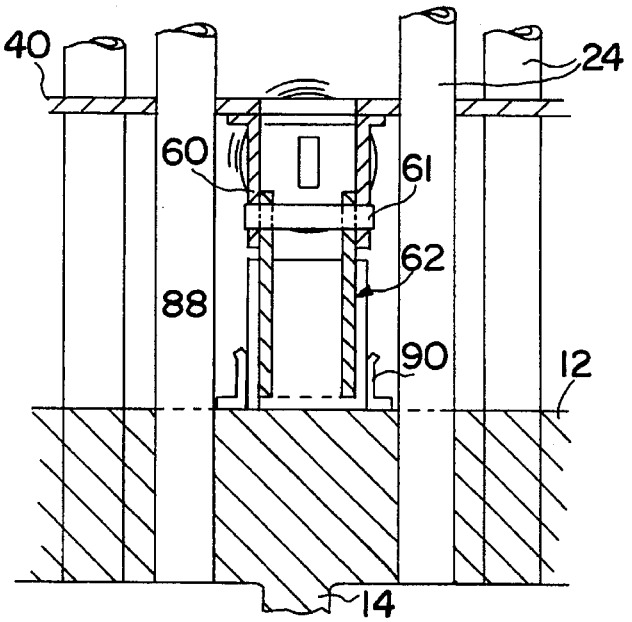
FIG. 7 is a view in cross-section of the pivoting block according to FIG. 6.

For this purpose, provision is advantageously made to provide the bottom end of the casing 26 with a sliding closure member 76, extending this casing downwards in the direction of the pin 68, this closure member having a notch 77, capable of straddling the adaptor 75 of the pin behind the shoulder 73, improving the immobilization of this pin and consequently the block 62 in normal operation of the generator. On the other hand, during the maintenance phase, the closure member 76 is raised by sliding against the wall of the casing 26, advantageously in lateral guides 80 (FIG. 5B) fixed on the latter, such that, after retraction of the pin and lifting of the closure member, the block 62 can be pivoting without risk of encountering any obstacle FIGS. 6 and 7 illustrate an alternative embodiment in which the block 62 for occupying the tube lane is arranged so as to have a substantially larger longitudinal dimension, consisting, for example, of three juxtaposed elements 82, 84 and 86 each provided with at least one element for passage of the secondary fluid, these elements being solidly attached to each other and arranged in the extension of each other. The first element 82, situated furthest to the left in FIG. 6, includes an extension for the articulation of the block 62 about the spindle 61 on the clevis 60 carried by the plate 40, while the opposite element 86 has a larger height dimension and is optionally provided with a protective sleeve 88.

The blocking pin 68 integral with the cover 70, the lower casing 26 and the sliding closure member are seen in these figures, it being possible for the latter to be arranged either on the inner face of this casing (FIG. 6) or, as before, on the outer face (FIGS. 5A and 5B).

Advantageously, slides 90 are arranged in line with the block 62 and more particularly the end element 86 thereof, which slides are arranged parallel to the lateral faces of this element and are solidly attached to the plate 12 in the example represented. They could also be carried by another fixed structure of the generator inside the region 64, optionally even by the lower end of the sliding closure member 76, upward retraction of the latter against the wall of the inner casing 26 not preventing positioning of these slides at a suitable level for accurately guiding the block in its pivoting movement without, clearly, impairing or hindering this movement.

Figure 8:
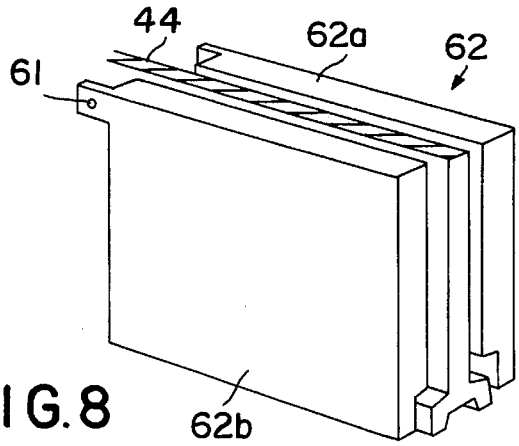
FIG. 8 schematically illustrates the adaptation of a pivoting block of the type described hereinabove to a generator of the economizer type.
Figure 9:
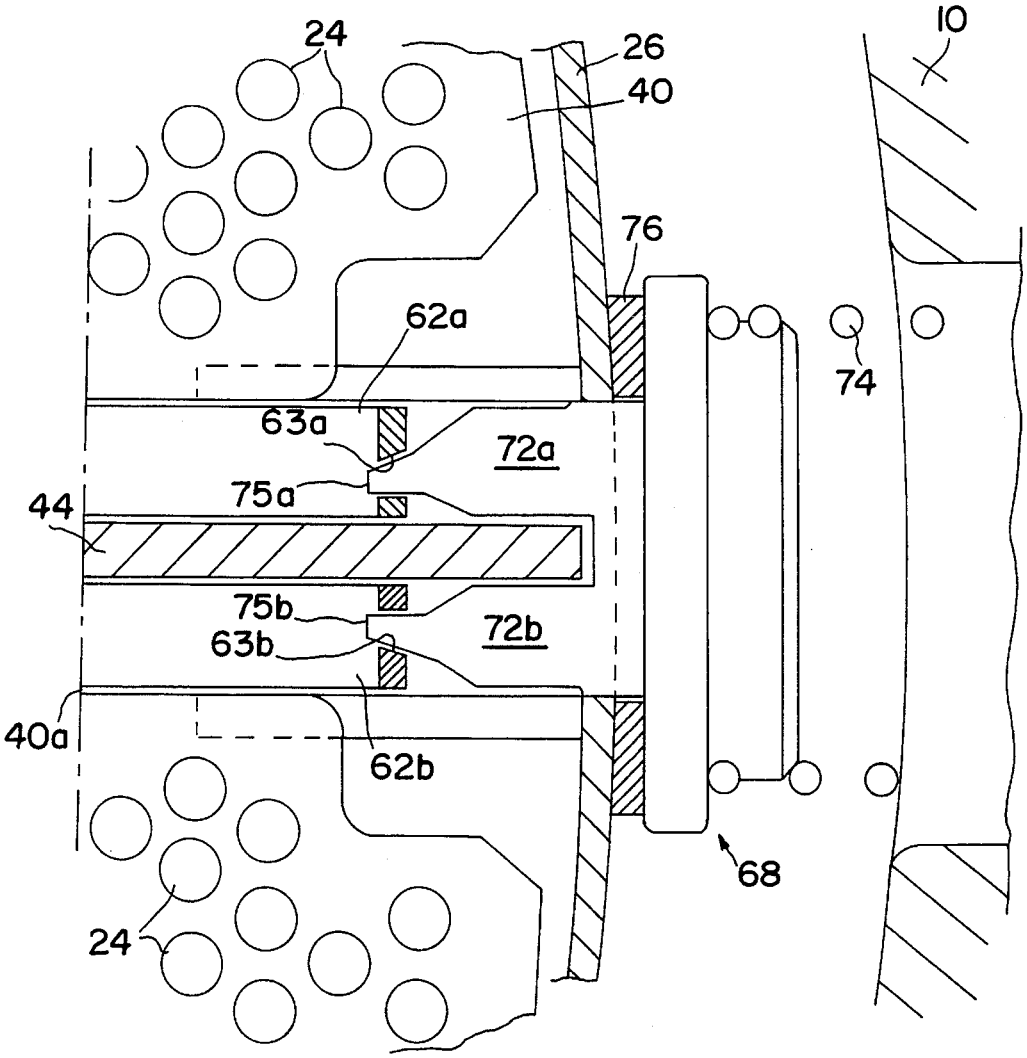
FIG. 9 is a plan view of the pivoting block according to FIG. 8 and of the means for immobilizing it.

FIGS. 8 and 9 schematically represent the adaptation of the arrangements employed in a steam generator of the boiler type according to FIG. 1, to a generator of the economizer type according to FIG. 2.

FIG. 8 represents a portion of the vertical separating partition 44 which extends longitudinally in the tube lane, the parallelepipedal block 62 consisting of two similar blocks 62*a* and 62*b* respectively articulated together about the spindle 61 and arranged parallel to each other on each side of the partition 44.

Similarly, in FIG. 9, the same elements are seen suitably duplicated, especially as regards the adaptors 72*a* and 72*b* and the housings 63*a* and 63*b* of the blocks 62*a* and 62*b* in which the ends 75*a* and 75*b* of these adaptors engage in order to simultaneously immobilize the two parallel blocks, or vice versa, when the blocking pin 68 is retracted, allowing upwards pivoting of these blocks through the slot 40*a* of the plate 40.

The invention thus makes it possible to arrange the tube lane of a steam generator, of the boiler or economizer type, in a particularly advantageous manner, by obstructing or "blocking" the region corresponding to the center of the generator between the branches of the closest tubes, without thereby limiting the possibilities of maintaining and servicing the generator, in particular to allow the passage towards the center of the tube plate of the tooling necessary for inspecting or repairing the tubes or the plate.

The pivoting mounting of the blocks is such that, by virtue of the immobilization pins, themselves locked by the sliding closure member of the inner casing, the device has no risk of liftoff or raising of the blocks during the in-service use of the generator, in particular under the effect of the pressure and/or the speed of the secondary fluid inflow.

The assembly is simple to produce, has no difficulties for fitting it in the tube lane of the generator and can be employed easily, in particular during shutdown of the generator, by using only the force necessary for pivoting the block in order to uncover the region which occupies it.

I claim:

1. Steam generator for a nuclear power station, including an outer casing of vertical axis, a horizontal tube plate fixed in a leaktight manner inside and at the lower end of said outer casing, a bundle of inverted-U tubes, comprising vertical branches, respectively hot and cold branches joined by a bent part at upper ends of said branches and traversed by a primary fluid which yields heat to a secondary fluid flowing through said outer casing, said branches of said U-tubes having lower ends connected to said tube plate and emerging thereunder, respectively in an inlet manifold for the hot primary fluid and an outlet manifold for cooled fluid, an inner casing covering said bundle and having a lower edge separated from said tube plate by a space and delimiting with said outer casing an annular space traversed by secondary fluid introduced into said casing in said space before vaporizing in contact with the tubes traversed by the primary fluid, steam extraction means, arranged above said bundle in said outer casing, and means for deflecting and distributing the flow of said secondary fluid, provided at the lower part of said inner casing, said deflecting means delimiting with said tube plate, on the one hand, and the hot and cold branches of the nearest tubes, on the other hand, an elongate central region extending transversely through said outer casing, said central region being occupied by means for blockage or partial occupation of the passage afforded to the secondary fluid in said central region, said means consisting of at least one block articulated on a fixed horizontal pivoting spindle mounted inside said outer casing and extending perpendicularly to a midplane of the said central region between the hot and cold branches of the tubes of said bundle, so as to allow pivoting of said block away from said tube plate, uncovering said region above said tube plate.

2. Steam generator according to claim 1, wherein said pivoting spindle is supported by a clevis integral with the deflection and distribution place carried by said inner casing, extending parallel to and above said tube plate.

3. Steam generator according to claim 1, wherein said block includes at least one open housing capable of receiving a temporary immobilization pin holding said block bearing on said tube plate and preventing it from rising under the effect of the speed of the secondary fluid flowing between said bundle of the tubes, said pin being slidingly mounted with respect to said housing.

4. Steam generator according to claim 3, wherein said pin is supported by a closure cover closing an access and visit hole located in said outer casing in the vicinity of said tube plate, substantially in the midplane of said central region.

5. Steam generator according to claim 4, wherein said pin engages in the housing of said block after passing through a sliding closure member carried by said inner casing, covering the bundle of the tubes, said pin including a telescopic mounting comprising a support finger integral with said cover penetrating in a blind bore made in said pin, a return spring being mounted between said cover and a bearing shoulder on said pin, so as to exert thereon a continuous force for engagement in the housing of said block.

6. Steam generator according to claim 5, wherein said pin has a conical profile, capable of interacting with a similar profile of said housing.

7. Steam generator according to claim 5, wherein said sliding closure member is supported by said inner casing so as to be able to retract in the direction of the upper part thereof, after withdrawal of said pin and release of said block, in order to allow free pivoting of said block.

8. Steam generator according to claim 1, wherein said block is guided laterally in its pivoting movement by two parallel slides, delimiting the sides of the central region between the tubes on either side of said block.

9. Steam generator according to claim 8, wherein said block is made in a single piece with a single immobilization pin.

10. Steam generator according to claim 8, wherein said block is made in two parallel parts, said pin being double and straddling a vertical deflector integral with the tube plate in the central region.

11. Steam generator according to claim 1, wherein said block is formed by a plurality of juxtaposed elements, arranged in extension of each other in the longitudinal direction of the central region, said elements each including passage openings for the secondary fluid.

* * * * *